US010926377B2

(12) United States Patent
Broussard

(10) Patent No.: US 10,926,377 B2
(45) Date of Patent: Feb. 23, 2021

(54) SANDING PAD FOR A SANDER, SUCH AS AN ECCENTRIC SANDER

(71) Applicant: Quintin James Broussard, Workum (NL)

(72) Inventor: Quintin James Broussard, Workum (NL)

( * ) Notice: Subject to any disclaimer, the term of this patent is extended or adjusted under 35 U.S.C. 154(b) by 398 days.

(21) Appl. No.: 15/778,751

(22) PCT Filed: Oct. 24, 2016

(86) PCT No.: PCT/NL2016/050731

§ 371 (c)(1),
(2) Date: May 24, 2018

(87) PCT Pub. No.: WO2017/091063

PCT Pub. Date: Jun. 1, 2017

(65) Prior Publication Data

US 2018/0345458 A1 Dec. 6, 2018

(30) Foreign Application Priority Data

Nov. 26, 2015 (NL) ..... 2015861

(51) Int. Cl.
*B24D 9/08* (2006.01)

(52) U.S. Cl.
CPC ..... *B24D 9/085* (2013.01); *B24D 9/08* (2013.01)

(58) Field of Classification Search
CPC ..... B24D 9/08; B24D 9/085
USPC ..... 451/359
See application file for complete search history.

(56) References Cited

U.S. PATENT DOCUMENTS 1,786,320 A 12/1930 Stratford
2,359,608 A * 10/1944 Baur ..... B24D 9/08 451/511
2,410,812 A * 11/1946 De Michel ..... B24D 9/08 451/488
2,439,751 A 4/1948 Olsen
2,480,886 A * 9/1949 Stever ..... B24B 45/006 451/509

(Continued)

FOREIGN PATENT DOCUMENTS

CA 2511068 A1 * 7/2004 ..... B24B 45/006
EP 0379361 A1 * 7/1990 ..... B24D 11/001

(Continued)

*Primary Examiner* — George B Nguyen
(74) *Attorney, Agent, or Firm* — The Webb Law Firm

(57) ABSTRACT

The invention relates to a sanding pad for a sander, such as an eccentric sander, which sanding pad includes a disc-shaped body with a rotation axis. The disc-shaped body has a first and second side extending substantially radially from the rotation axis and a third peripheral side extending between the first and second side. The sanding pad includes a coupling arranged on the first side, concentrically with the rotation axis, for coupling to a sander, a disc-shaped flexible plate which is arranged concentrically with the rotation axis and which lies with a first side against the second side of the disc-shaped body, where the disc-shaped flexible plate extends beyond the peripheral side as seen in radial direction; and attaching means for attaching a sanding layer arranged on a second side of the disc-shaped flexible plate opposite the first side of the plate.

19 Claims, 2 Drawing Sheets

(56) References Cited

U.S. PATENT DOCUMENTS 2,696,700 A * 12/1954 Tocci ..... B24D 9/085 451/510
3,883,998 A * 5/1975 Dosser ..... B24D 9/085 451/508
5,001,804 A * 3/1991 Roeker ..... B24D 9/085 15/230
5,170,595 A * 12/1992 Wiand ..... B24D 9/085 15/230
5,384,988 A * 1/1995 Hernandez ..... B24B 13/01 451/42
6,220,948 B1 * 4/2001 Carballo ..... B24B 23/04 451/356
2002/0132573 A1 * 9/2002 Rich ..... B24D 9/08 451/539
2005/0227599 A1 * 10/2005 Fisher ..... B24B 23/005 451/526
2005/0227600 A1 * 10/2005 Fisher ..... B24D 9/085 451/538
2006/0053576 A1 * 3/2006 McLain ..... B24D 13/147 15/230
2008/0216272 A1 * 9/2008 McLain ..... B24D 13/147 15/230.18
2009/0191376 A1 * 7/2009 Rivard ..... B24B 45/006 428/100
2012/0142255 A1 * 6/2012 Panergo ..... B24B 27/0038 451/28
2016/0052102 A1 2/2016 Sato

FOREIGN PATENT DOCUMENTS

GB 490287 A 8/1938
WO WO-02060644 A1 * 8/2002 ..... B24D 9/085
WO 2014165394 A1 10/2014

* cited by examiner

SANDING PAD FOR A SANDER, SUCH AS AN ECCENTRIC SANDER

CROSS-REFERENCE TO RELATED APPLICATIONS

This application is the United States national phase of International Application No. PCT/NL2016/050731 filed Oct. 24, 2016, and claims priority to The Netherlands Patent Application No. 2015861 filed Nov. 26, 2015, the disclosures of which are hereby incorporated in their entirety by reference.

BACKGROUND OF THE INVENTION

Field of the Invention

The invention relates to a sanding pad for a sander, such as an eccentric sander, which sanding pad comprises:

- a disc-shaped body with a rotation axis, wherein the disc-shaped body has a first and second side extending substantially radially from the rotation axis and a third peripheral side extending between the first and second side; and
- a coupling arranged on the first side, concentrically with the rotation axis, for coupling to a sander.

Description of Related Art

Such sanding pads are connected to the motor of a sander with the coupling and can in this way be used for diverse sanding applications, such as for instance mechanical sanding of yachts. Although such sanding pads generally suffice for the relatively flat parts, these sanding pads are not suitable for use on curved surfaces because of the chance of damage, such as cuts, in these surfaces.

For this reason use is not made of the mechanical applications in sanding of curved surfaces, but such surfaces are still sanded manually, for instance using a flexible disc. Sanding curved surfaces in this way takes a great deal of time.

SUMMARY OF THE INVENTION

It is now an object of the invention to reduce or even obviate the above stated problems.

This object is achieved by means of a sanding pad, further comprising:

- a disc-shaped flexible plate which is arranged concentrically with the rotation axis and which lies with a first side against the second side of the disc-shaped body, wherein the disc-shaped flexible plate extends beyond the peripheral side as seen in radial direction; and
- attaching means for attaching a sanding layer arranged on a second side of the disc-shaped flexible plate opposite the first side of the plate.

The first side of the flexible plate lies here partially against the second side of the disc-shaped body, but an unattached part thereof extends beyond the peripheral side. A sanding layer can be arranged on the second side of the flexible plate by means of the attachment.

When the unattached part of the flexible plate encounters a curvature in the surface to be sanded with the sanding layer, it will follow the curvature, this reducing the chance of damage to the surface during sanding with this sanding pad. The shape of the peripheral side determines here the maximum curvature of the flexible plate. The choice of material and dimensions of the flexible plate have to be adjusted to this curvature. Manual sanding is no longer necessary with this sanding pad, and the efficiency is thus increased.

The sanding pad according to the invention is also suitable for application in more complex curved surfaces because the unattached sides of the flexible plate can easily shape themselves to all curvatures around the disc-shaped body.

The flexible plate and the attaching means for attaching the sanding layer are mutually fixed in a suitable manner, and preferably by means of glueing.

In a preferred embodiment of the sanding pad according to the invention the length of the part of the flexible plate which extends beyond the peripheral side as seen in radial direction is equal to or greater than the distance between the first side and the second side.

Such a length of the unattached part of the flexible part guarantees that the unattached part has a sufficient surface area relative to the disc-shaped part, which can shape itself to curvatures in the surface and herein prevent damage to the surface to be sanded.

In another preferred embodiment of the sanding pad according to the invention the second side transposes smoothly into the peripheral side.

Smoothly is understood to mean here that the tangent of the second side to the edge and in radial direction is equal to the tangent of the peripheral side to the edge in radial direction. This forms a surface against which the flexible plate can lie in easy and stable manner in the case of maximum curvature during sanding of curved surfaces.

In a further preferred embodiment of the sanding pad according to the invention the peripheral side is partially torus-shaped adjacent to the second side, and the torus shape is coaxial with the rotation axis.

The torus shape of the peripheral side has a primary radius from the centre of the pad to the centre of the circle of the torus shape. The circle of the torus shape has a secondary radius.

Because of the torus shape, a smooth transition between the second side and the peripheral side is obtained and the flexible plate is also curved uniformly around the disc-shaped body in the case of maximum curvature, which increases the stability of the sanding pad during use.

Because of the torus shape, when maximum curvature is reached the outer end of the flexible plate is here moreover substantially perpendicular to the part of the flexible plate extending under the second side of the disc-shaped body, whereby a wide range of curvatures can be sanded.

The secondary radius of the torus shape is preferably equal to or greater than 8 millimetres.

Such a chosen secondary radius ensures sufficient space for the flexible plate to gradually shape itself all around the disc-shaped body when reaching a curvature in the surface for sanding, this in comparison to smaller values of the secondary radius, wherein the associated rapidly rising curvature can still cause damage.

In another preferred embodiment of the sanding pad according to the invention the disc-shaped body comprises a rigid core plate and a foam layer, wherein the coupling is arranged on the rigid core plate.

The rigid core plate provides here the necessary rigidity for mounting the coupling on the sanding pad and for transmitting the force of the motor of a sander to the sanding pad. The foam layer here increases the flexibility for shaping of the flexible plate when curvatures are encountered in the surface for treating.

The core plate is preferably embedded in the foam layer.

When the foam layer thus forms an upright edge lying all around the core plate, the flexible plate will not come into contact with the core plate when curved but only with the foam layer, whereby curving of the flexible plate is simplified.

In a preferred embodiment of the sanding pad according to the invention the attaching means comprise hook and loop fastening tape.

Hook and loop fastening tape (also known as velcro) is a versatile, inexpensive and suitable manner of attaching a sanding layer to the sanding pad. There is moreover the advantage that hook and loop fastening tape, also with a sanding layer attached thereto, adapts its shape easily when the flexible plate lying thereabove is curved when reaching a curvature in the surface for sanding.

In another preferred embodiment of the sanding pad according to the invention the part of the disc-shaped flexible plate extending beyond the peripheral side as seen in radial direction lies at least partially against a part of the peripheral wall during use.

The disc-shaped body here supports this part of the flexible plate with the peripheral side during sanding of curved surfaces.

Although sanding pads according to the invention are in this case described in respect of the sanding of surfaces, they can likewise be applied in similar manner in other fields, such as for instance in cleaning machines or polishing machines.

BRIEF DESCRIPTION OF THE DRAWINGS

These and other aspects of the invention are elucidated with reference to the following figures.

DESCRIPTION OF THE INVENTION

Figure 1:
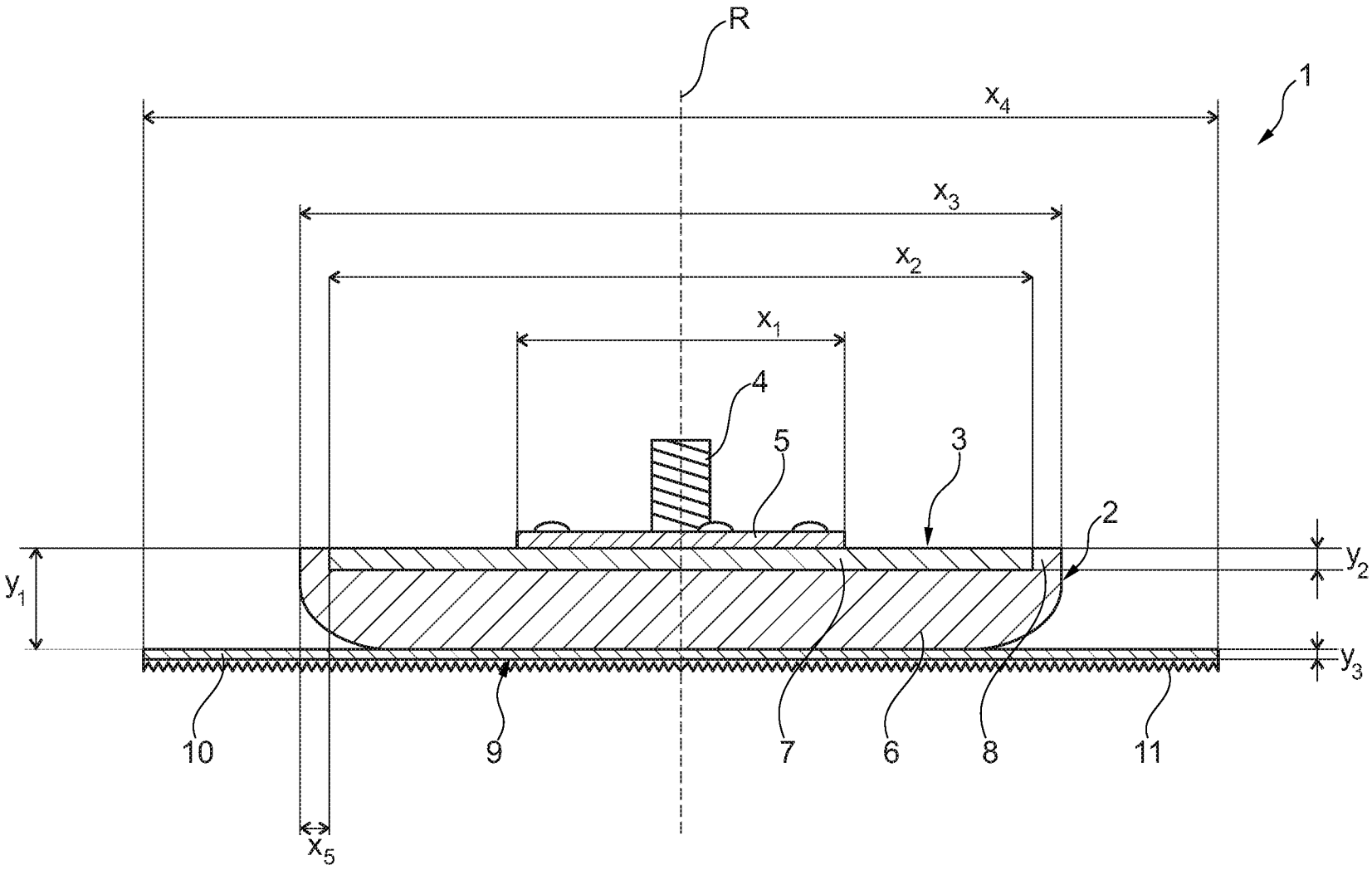
FIG. 1 shows a cross-section of a sanding pad according to the invention.
Figure 2:
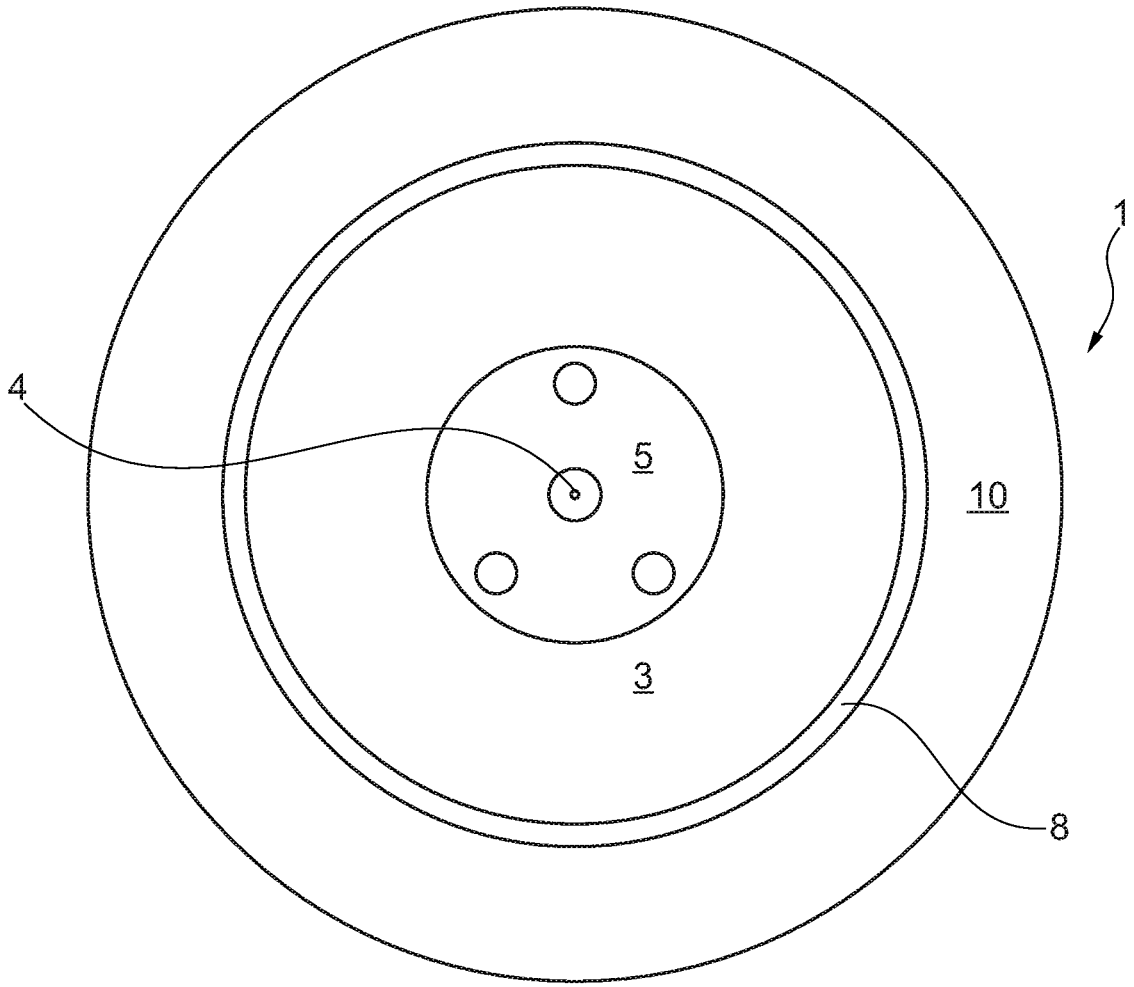
FIG. 2 shows a top view of a sanding pad according to the invention.

FIGS. 1 and 2 show a sanding pad 1 according to the invention. Sanding pad 1 is constructed from a disc-shaped body 2, rotatable around a rotation axis R. A connecting screw 4 is arranged on disc-shaped body 2 on the first or upper side 3, concentrically with rotation axis R, by means of connecting plate 5. Connecting screw 4 can be fastened to a sander (not shown).

Disc-shaped body 2 is constructed from a foam layer 6 and core plate 7 arranged thereon concentrically with rotation axis R. Core plate 7 is embedded in foam layer 6, whereby an upright edge 8 is formed all around core plate 7. Foam layer 6 has a torus shape all around the underside 9 of disc-shaped body 2.

A flexible plate 10, which can curve around foam layer 6 when encountering a curvature in the surface for treating, is arranged on the second or underside 9 of disc-shaped body 2, concentrically with rotation axis R, using a glue layer (not shown). A layer of hook and loop fastening tape 11 is arranged on the underside of flexible plate 10 for attaching a sanding layer thereto.

In an advantageous embodiment the flexible plate is made of polycarbonate and the dimensions are as follows. Disc-shaped body 2 has a height $Y_1$ of 15 millimetres. The height $Y_2$ of upright edge 8 is here 3 millimetres. The height $Y_3$ of flexible plate 10 is 0.480 millimetres. The diameter $X_1$ of coupling plate 5 is 45 millimetres. The diameter $X_2$ of core plate 7 is 99 millimetres. The diameter $X_3$ of foam layer 6 is 105 millimetres. The diameter $X_4$ of flexible plate 10 and the hook and loop fastening tape 11 fixed thereto is 148 millimetres. The width $X_5$ of edge 8 is 3 millimetres.

In addition to giving an example of an advantageous embodiment, the dimensions described here also give an indication of advantageous ratios of these dimensions. If it is desired here to increase the diameter, and thereby the surface of the flexible plate with attaching means, it will generally also be desired for a good operation to increase the dimensions of the sanding pad perpendicularly of this surface.

The invention claimed is:

1. A sanding pad for a sander, comprising:

a disc-shaped body with a rotation axis, wherein the disc-shaped body has a first and second side extending substantially radially from the rotation axis and a third peripheral side extending between the first and second side in which the second side of the disk shaped body transposes smoothly into the peripheral side;

a coupling arranged on the first side, concentrically with the rotation axis, for coupling to a sander;

a disc-shaped flexible plate which is arranged concentrically with the rotation axis and which lies with a first side against the second side of the disc-shaped body, wherein the disc-shaped flexible plate extends beyond the peripheral side as seen in the radial direction; and attaching means for attaching a sanding layer arranged on a second side of the disc-shaped flexible plate opposite the first side of the plate.

2. The sanding pad as claimed in claim 1, wherein the length of the part of the flexible plate which extends beyond the peripheral side as seen in the radial direction is equal to or greater than the distance between the first side and the second side.

3. The sanding pad as claimed in claim 1, wherein the peripheral side is partially torus-shaped adjacent to the second side and wherein the torus shape is coaxial with the rotation axis.

4. The sanding pad as claimed in claim 1, wherein a secondary radius of the torus shape is equal to or greater than 8 millimetres.

5. The sanding pad as claimed in claim 1, wherein the disc-shaped body comprises a rigid core plate and a foam layer, wherein the coupling is arranged on the rigid core plate.

6. The sanding pad as claimed in claim 5, wherein the core plate is embedded in the foam layer.

7. The sanding pad as claimed in claim 1, wherein the attaching means comprise hook and loop fastening tape.

8. The sanding pad as claimed in claim 1, wherein the part of the disc-shaped flexible plate extending beyond the peripheral side as seen in the radial direction lies at least partially against a part of the peripheral wall during use.

9. The sanding pad as claimed in claim 2, wherein the second side transposes smoothly into the peripheral side.

10. The sanding pad as claimed in claim 3, wherein a secondary radius of the torus shape is equal to or greater than 8 millimetres.

11. The sanding pad as claimed in claim 2, wherein the disc-shaped body comprises a rigid core plate and a foam layer, wherein the coupling is arranged on the rigid core plate.

12. The sanding pad as claimed in claim 1, wherein the disc-shaped body comprises a rigid core plate and a foam layer, wherein the coupling is arranged on the rigid core plate.

13. The sanding pad as claimed in claim 3, wherein the disc-shaped body comprises a rigid core plate and a foam layer, wherein the coupling is arranged on the rigid core plate.

14. The sanding pad as claimed in claim 4, wherein the disc-shaped body comprises a rigid core plate and a foam layer, wherein the coupling is arranged on the rigid core plate.

15. The sanding pad as claimed in claim 2, wherein the attaching means comprise hook and loop fastening tape.

16. The sanding pad as claimed in claim 1, wherein the attaching means comprise hook and loop fastening tape.

17. The sanding pad as claimed in claim 2, wherein the part of the disc-shaped flexible plate extending beyond the peripheral side as seen in the radial direction lies at least partially against a part of the peripheral wall during use.

18. The sanding pad as claimed in claim 1, wherein the part of the disc-shaped flexible plate extending beyond the peripheral side as seen in the radial direction lies at least partially against a part of the peripheral wall during use.

19. The sanding pad as claimed in claim 3, wherein the part of the disc-shaped flexible plate extending beyond the peripheral side as seen in the radial direction lies at least partially against a part of the peripheral wall during use.

* * * * *